US006472810B1

(12) United States Patent
Teramoto et al.

(10) Patent No.: US 6,472,810 B1
(45) Date of Patent: Oct. 29, 2002

(54) LIGHT SOURCE DEVICE, EXPOSURE APPARATUS AND CATHODE RAY TUBE PANEL

(75) Inventors: Hiroshi Teramoto, Tokyo (JP); Nobuyuki Zumoto, Tokyo (JP); Shigeru Nishimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 271 days.

(21) Appl. No.: 09/599,876

(22) Filed: Jun. 23, 2000

(30) Foreign Application Priority Data

Jun. 24, 1999 (JP) ..... 11-178136

(51) Int. Cl.[7] ..... H01J 29/10
(52) U.S. Cl. ..... 313/476; 313/479; 313/474
(58) Field of Search ..... 313/461, 476, 313/478, 479, 477 R, 474, 482

(56) References Cited

U.S. PATENT DOCUMENTS 3,888,673 A * 6/1975 Suzuki et al. ..... 96/36.1
5,434,470 A * 7/1995 De Wit et al. ..... 313/402

* cited by examiner

*Primary Examiner*—Robert H. Kim
*Assistant Examiner*—Jurie Yun
(74) *Attorney, Agent, or Firm*—Birch, Stewart, Kolasch & Birch, LLP

(57) ABSTRACT

A light device includes a shielding plate (2) having an opening (2H) of a rectangular cross-sectional configuration and placed over an optical window retainer (15). The shielding plate (2) is placed so that an opening wall surface (2HS) thereof is positioned on an optical path (Zr(x)) of light emerging from an optical window (14) at a usable angle (θe) and that a half width (Xu) of the opening (2H) satisfies $Xu=u/\cot(\theta e)+t\times\sin(\theta e)/\mathrm{sgrt}(n_g^2-\sin^2(\theta e))+s$. The optical window retainer (15) is placed in a region outside a boundary line given as $Zh(x)=\pm(1\times\tan(\theta e)(x\pm Xu)+u$ (plus (+) when $x\leqq -Xu$; minus (−) when $x\geqq Xu$) and also in aregion outside the optical path (Zr(x)). The light source device suppresses an uneven illuminance distribution of exposure light resulting from superimposition of light scattered from the opening wall surface of the optical window retainer upon the exposure light.

14 Claims, 11 Drawing Sheets

LIGHT SOURCE DEVICE, EXPOSURE APPARATUS AND CATHODE RAY TUBE PANEL

BACKGROUND OF THE INVENTION

1. Field of the Invention

The present invention relates to a light source device incorporated in an exposure apparatus for usc in the manufacture of a panel of a cathode ray tube (referred to hereinafter as a "CRT"). More particularly, the invention relates to a light source device capable of intercepting light such as reflected or scattered light which results in uneven exposure to reduce uneven exposure, thereby achieving high-quality exposure.

2. Description of the Background Art

A phosphor screen on the inner surface of a panel of a CRT for use as a display monitor and the like has a black matrix (referred to hereinafter as a "BM") produced using resist exposure, and a three-color phosphor pattern produced using direct exposure.

FIG. 11 is a plane view (with a vertical section taken along the line I–II of an enlarged part) for illustrating a structure of the phosphor screen formed on a CRT panel 70 by using an exposure apparatus. In FIG. 11, the reference numeral 701 designates a BM for providing clear separation between phosphors to enhance an image quality; and 702, 703 and 704 designate red-emitting (R), green-emitting (G) and blue-emitting (CB) phosphors, respectively, which are formed in stripe-shaped configuration in predetermined positions of openings of the BM 701.

The phosphor screen shown in FIG. 11 is formed in the steps of forming the BM 701 by a lift-off method using resist exposure, and repeating for R, G and B in any order the process of applying a photosensitive phosphor material, e.g., for G to the inner surface of the panel on which the BM 701 is formed to leave phosphor stripes, e.g. green-emitting phosphor stripes, in the predetermined positions of the openings of the BM 701 by direct exposure and development processes.

FIG. 12 is a cross-sectional view of an exposure apparatus for use in the manufacture of the CRT panel 70 shown in FIG. 11. In FIG. 12, the reference numeral 1 designates a light source device; 20 designates a light control filter; 40 designates a wedge lens; 50 designates a correction lens; and 60 designates a mask. Light emitted from the light source device 1 passes through the light control filter 20, the wedge lens 40 and the connection lens 50 onto the mask 60. The resultant shadow of the mask 60 is projected onto the inner surface of the CRT panel 70, whereby a predetermined pattern is exposed to light.

FIG. 13 is a enlarged view of a portion indicated by the arc C1 of FIG. 12, and illustrates paths of light beams passing through the mask 60 in detail. With reference to FIG. 13, light of a predetermined color or predetermined wavelength which is emitted from the light source device 1 impinges upon the inner surface of the CRT panel 70 in stripe-shaped configuration conforming to the openings of the mask 60.

FIG. 14 is a vertical sectional view of the conventional light source device 1 for use in the exposure apparatus shown in FIG. 12 In FIG. 14, the reference numeral 11 designates a rod-shaped mercury light source having a light emitting region extending linearly in the x-direction; 12 designates a light source slit for partially intercepting light emitted from the mercury light source 11 to restrict an apparent light source configuration, and having a centrally located opening for allowing light to pass therethrough; and 13 designates a Light source housing for holding the mercury light source 11 in its interior space by using O-rings 16. The interior space of the light source housing 13 (having an opening in its upper surface part) in the vicinity of the light emitting region of the mercury light source 11 is filled with a coolant 17 for cooling the mercury light source 11. The reference numeral 14 designates an optical window having a lower surface for contact with the upper surface part of the light source housing 13 having the opening, with one of the O-rings 16 therebetween, to confine the coolant 17 within the interior space of the housing 13 and to direct the light from the mercury light source 11 through an upper surface thereof into the atmosphere. Additionally, the light source housing 13 includes an inlet and an outlet both not shown of the coolant 17, and discharges the coolant 17 through the outlet while feeding the coolant 17 through the inlet into the interior space of the housing 13 at a pressure not less than atmospheric pressure, thereby maintaining constant the temperature of the coolant 17 in the light source housing 13. Thus, since the pressure in the interior space of the light source housing 13 filled with the coolant 17 is always higher than the atmospheric pressure, the optical window 14 is held by an optical window retainer 15 applying a pressure from the atmosphere toward the upper surface part of the light source housing 13, with the O-ring 16 therebetween. The optical window retainer 15 has a centrally located opening 15H which is circular in cross section (which is a section parallel to an xy plane), and is screw-held to the housing 13 by means of a threaded groove not shown formed in the light source housing 13.

In the conventional light source device constructed as above described, it is essential that the optical window retainer is provided on the atmosphere side of the optical window. This presents a problem to be described below.

Detailed consideration of one light profile on the inner surface of the CRT panel being exposed to exposure light emitted from the light source device provides a distribution as shown in FIG. 15. It will be understood from FIG. 15 that a pattern width changes depending on the level of illuminance. In other words, when a component other than a predetermined light distribution is superimposed on the illuminance distribution of the exposure light, the distribution of the pattern width within the panel surface shows unevenness corresponding to the superimposed component.

Tracking a light beam emitted from the mercury light source 11 of FIG. 14 and passing through the inside of the coolant 17 and the optical window 14 into the atmosphere provides a light path as shown in FIG. 16. As illustrated in FIG. 16, a light beam 91 generated in a linear light emitting region 111 of the mercury light source 11 and travailing in the region 111 at an angle $\theta_i$ passes through the wall of a synthetic quartz tube 112 surrounding the light emitting region 111 at an angle $\theta_j$ and then through the coolant 17 and the optical window 14 at angles $\theta_0$ and $\theta_1$ respectively, and emerges into the atmosphere at an outgoing angle $\theta$. The ranges of the angles $\theta_i$, $\theta_j$, $\theta_0$, $\theta_1$ and $\theta$ of the respective light beams 91 to 95 are calculated below. The angle $\theta_i$ of the light beam 91 emitted from the light emitting region 111 is less than a maximum of ±90° (See Expression (1)) since a light beam having an angular component ranging from 0° to less than 90° can pass through the synthetic quartz tube 112. The maximum value of the angle $\theta_j$ of the light beam 92 in the synthetic quart tube is ±42.70° (See Expression (2)), and the maximum value of the angle $\theta_0$ of the light beam 93 in the coolant 17 is ±48.28° (See Expression (3)). The maximum value of the angle $\theta_1$ of the light beam 94 in the optical window 14 is ±42.70° (See Expression (4)). The maximum value of the angle θ of the light beam 95 in the atmosphere outside the optical window 14, which equals the angle $\theta_i$ in the light emitting region 111 as a result of calculation, is less than ±90° (See Expression (1)). That is, the light beam 93 emitted from the mercury light source 11 at the angle of ±48.28° at the maximum spreads out up to an approximately ±90° outgoing angle θ in the atmosphere outside the optical window 14.

$$0 \leqq |\theta| = |\theta_i| \leqq 90°$$

$$0 \leq |\theta_j| \leq \sin^{-1}\left(\frac{n_t}{n_s}\sin\theta_{i\max}\right) \approx 42.70° \quad (2)$$

where $n_1=1$ is the refractive index of air, $n_g=1.47454$ is the refractive index of synthetic quartz, and $\theta_{i\ max}=90°$.

$$0 \leq |\theta_o| \leq \tan^{-1}\left(\frac{1}{\sqrt{n_w^2-1}}\right) \approx 48.28° \quad (3)$$

where $n_w=1.33974$ is the refractive index of water.

$$0 \leq |\theta_1| \leq \sin^{-1}\left(\frac{1}{n_g}\right) \approx 42.70° \quad (4)$$

where $n_g=1.47454$ is the refractive index of synthetic quartz.

Because of the light path in the conventional light source device as described above, the light beam 95 emerging from the optical window 14 at an outgoing angle of approximately 90° impinges upon an opening wall surface 15HS of the optical window retainer 15, and the opening wall surface 15HS in turn serves as a secondary light source to generate reflected or scattered light 96. The reflected or scattered light 96 is superimposed upon the exposure light which reaches the inner surface of the CRT panel directly from the mercury light source 11 to cause an uneven illuminance distribution. This uneven illuminance distribution leads to an uneven pattern width of the black matrix (BM) and an uneven pattern width of the subsequently generated R, G and B phosphors because of the cause-and-effect relation described with reference to FIG. 15, resulting in the decreased quality of the phosphor screen.

SUMMARY OF THE INVENTION

A first aspect of the present invention is intended for a light source device incorporated in an exposure apparatus for use in manufacturing a cathode ray tube panel. According to the present invention, the light source device comprises a light source; a light source housing configured to hold the light source therein; an optical window configured to cause light from the light source to emerge into the atmosphere; an optical window retainer configured to fix the optical window to the light source housing; and a shielding plate placed over the optical window and the optical window retainer and having an opening wall surface extending inwardly beyond an opening wall surface of the optical window retainer to a position overlying the optical window, wherein an upper surface edge portion of the opening wall surface of the shielding plate is positioned in a region including and outside an optical path of outgoing light emerging from the optical window into the atmosphere at a predetermined angle, and wherein the optical window retainer is positioned in a region including and outside a boundary line passing through a position of a lower surface edge portion of the opening wall surface of the shielding plate and having a line-symmetrical relation to the optical path of the outgoing light.

Preferably, according to a second aspect of the present invention, in the light source device of the fist aspect, the upper surface edge portion of the opening wall surface of the shielding plate is positioned on the optical path of the outgoing light.

Preferably, according to a third aspect of the present invention, in the light source device of the first aspect, the upper surface edge portion of the opening wall surface of the shielding plate is positioned outside and near the optical path of the outgoing light.

Preferably, according to a fourth aspect of the present invention, in the light source device of the first aspect, an edge portion of the opening wall surface of the optical window retainer in contact with an upper surface of the optical window is set at a position on the boundary line.

Preferably, according to a fifth aspect of the present invention, in the light source device of the fourth aspect, the opening wall surface of the optical window retainer is a surface perpendicular to the upper surface of the optical window.

Preferably, according to a sixth aspect of the present invention, in the light source device of the fourth aspects the opening wall surface of the optical window retainer is a tapered surface extending along the boundary lie.

Preferably, according to a seventh aspect of the present invention, in the light source device of the first aspect, the predetermined angle is a usable angle of light defined as a maximum angle of direct light emerging from the optical window into the atmosphere and to be used for exposure.

According to an eighth aspect of the present invention, an exposure apparatus comprises the light source device as recited in the first aspect.

According to a ninth aspect of the present invention, a cathode ray tube panel comprises a phosphor screen manufactured using the exposure apparatus as recited in the eighth aspect.

A tenth aspect of the present invention is intended for a light source device incorporated in an exposure apparatus for use in manufacturing a cathode ray tube panel. According to the present invention, the light source device comprises: a light source; a light source housing configured to hold the light source therein; an optical window configured to cause light from the light source to emerge into the atmosphere; and an optical window retainer configured to fix the optical window to the light source housing and having an opening, wherein an opening wall surface of the optical window retainer has a first edge portion in contact with a surface of the optical window and a second edge portion on the opposite side from the first edge portion, and the second edge portion is positioned in a region including and outside an optical path of outgoing light emerging from the optical window into the atmosphere at a predetermined angle, and wherein the optical window retainer is positioned in a region including and outside a boundary line passing through the second edge portion and having a line-symmetrical relation to the optical path of the outgoing light.

Preferably, according to an eleventh aspect of the present invention, in the light source device of the tenth aspect, the second edge portion is positioned on the optical path of the outgoing light.

Preferably, according to a twelfth aspect of the present invention, in the light source device of the tenth aspect the second edge portion is positioned outside and near the optical path of the outgoing light.

Preferably, according to a thirteenth aspect of the present invention, in the light source device of the tenth aspect, the opening wall surface of the optical window retainer is a tapered surface extending along the boundary line.

Preferably, according to a fourteenth aspect of the present invention, in the light source device of the tenth aspect, the predetermined angle is a usable angle of light defined as a maximum angle of direct light emerging from the optical window into the atmosphere and to be used for exposure.

According to a fifteenth aspect of the present invention, an exposure apparatus comprises the light source device as recited in the tenth aspect.

According to a sixteenth aspect of the present invention, a cathode ray tube panel comprises a phosphor screen manufactured using the exposure apparatus as recited in the fifteenth aspect.

In accordance with the first, eighth and ninth aspects of the present invention, in the light source device for the CRT exposure apparatus, the shielding plate of a size determined by a predetermined optical calculation is placed outside the optical window and the optical window retainer is disposed in a position determined by a predetermined optical calculation so that light reflected or scattered from the opening wall surface of the optical window retainer is prevented from reaching an inner surface of the CRT panel. This eliminates the unevenness of an illuminance distribution of exposure light to eliminate the unevenness of a pattern width of a black matrix and the likes, thereby producing the effect of enhancing the quality of the CRT phosphor screen.

In accordance with the tenth, fifteenth and sixteenth aspects of the present invention, the optical window retainer has a configuration defined based on a predetermined optical calculation to prevent light reflected or scattered from the optical window retainer from reaching an inner surface of the CRT panel. This produces the effect of enhancing the quality of the phosphor screen formed on the inner surface of the CRT, similar to the above-mentioned effects.

It is therefore an object of the present invention to overcome a problem with a conventional light source device for an apparatus for exposing an inner surface of a CRT panel, i.e., to suppress the unevenness of an illuminance distribution of exposure light resulting from light reflected or scattered from an opening wall surface of an optical window retainer to eliminate the unevenness of pattern widths of a black matrix and phosphors, thereby improving the quality of a phosphor screen.

These and other objects, features, aspects and advantages of the present invention will become more apparent from the following detailed description of the present invention when taken in conjunction with the accompanying drawings.

DESCRIPTION OF THE PREFERRED EMBODIMENTS (First Preferred Embodiment)

Figure 12:
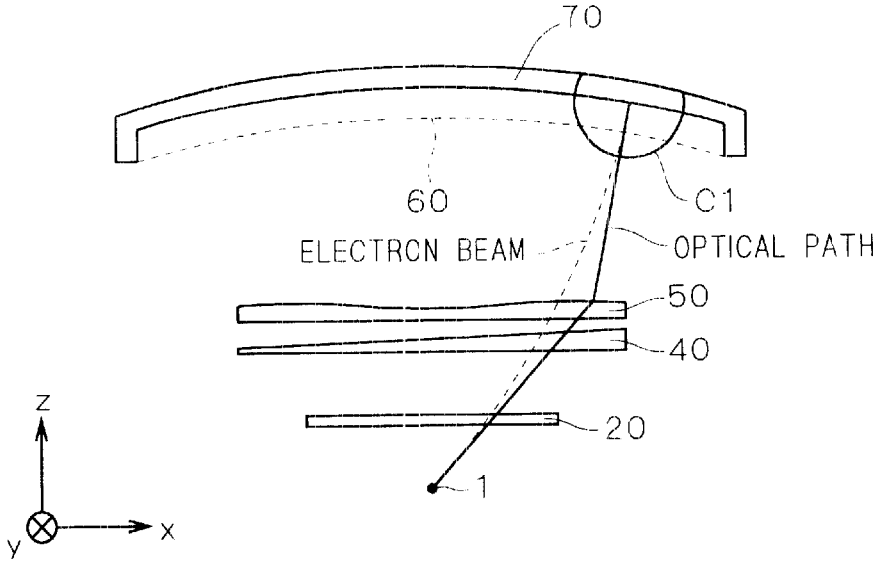
FIG. 12 (PRIOR ART)
FIG. 12 schematically illustrates a basic structure of an exposure apparatus.
Figure 13:
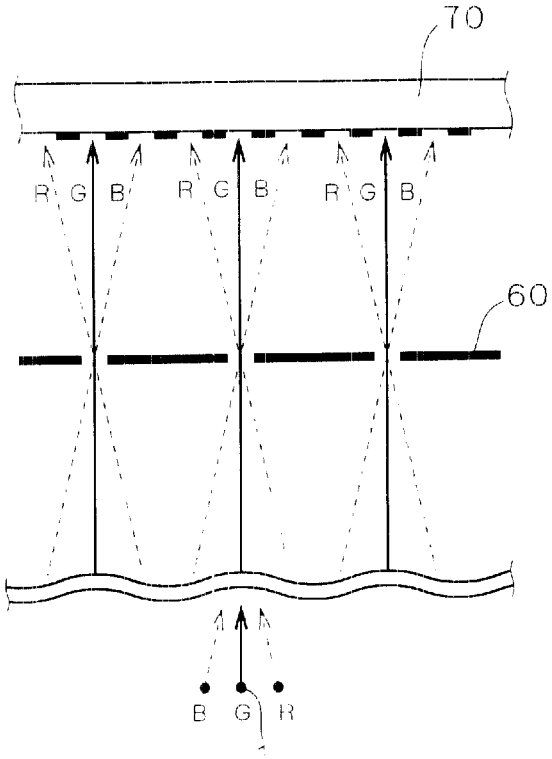
FIG. 13 (PRIOR ART)
FIG. 13 schematically illustrates a method of three-color exposure.

A light source device according to a first preferred embodiment of the present invention to be incorporated in an exposure apparatus for the manufacture of a CRT panel is such that a shielding plate is provided over an optical window retainer and that the optical window retainer and the shielding plate are placed in a positional relationship determined based on a predetermined equation. The light source device is thus improved to prevent light reflected or scattered from an opening wall surface of the optical window retainer from reaching the inner surface of the CRT panel. Features of the light source device according to the first preferred embodiment of the present invention will now be described with reference to the drawings. The exposure apparatus itself in which the light source device is incorporated to be described below is similar in construction to the conventional exposure apparatus shown in FIG. 12.

Figure 1:
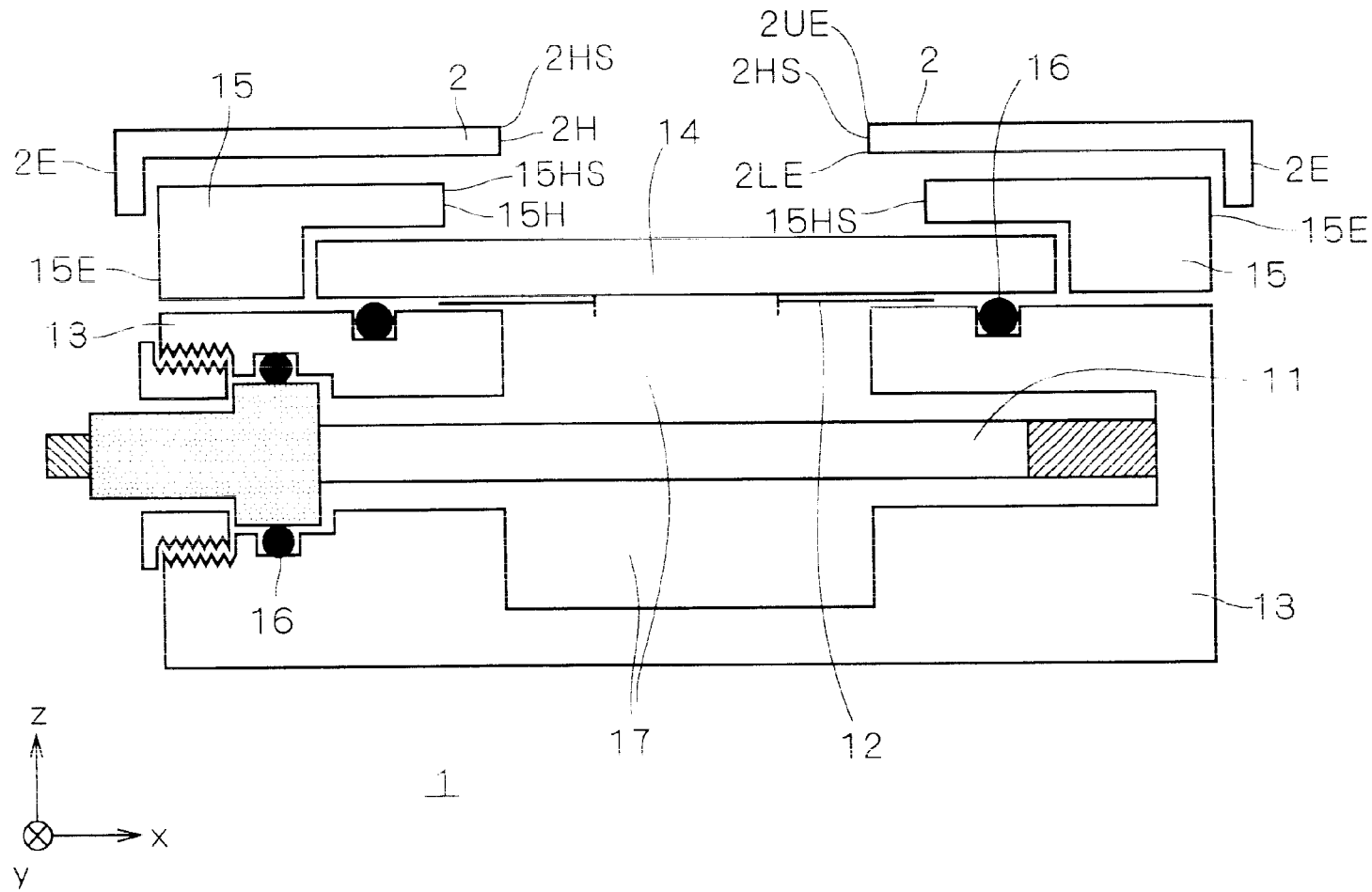
FIG. 1 is a vertical sectional view of a structure of a light source device according to a first preferred embodiment of the present invention.
Figure 14:
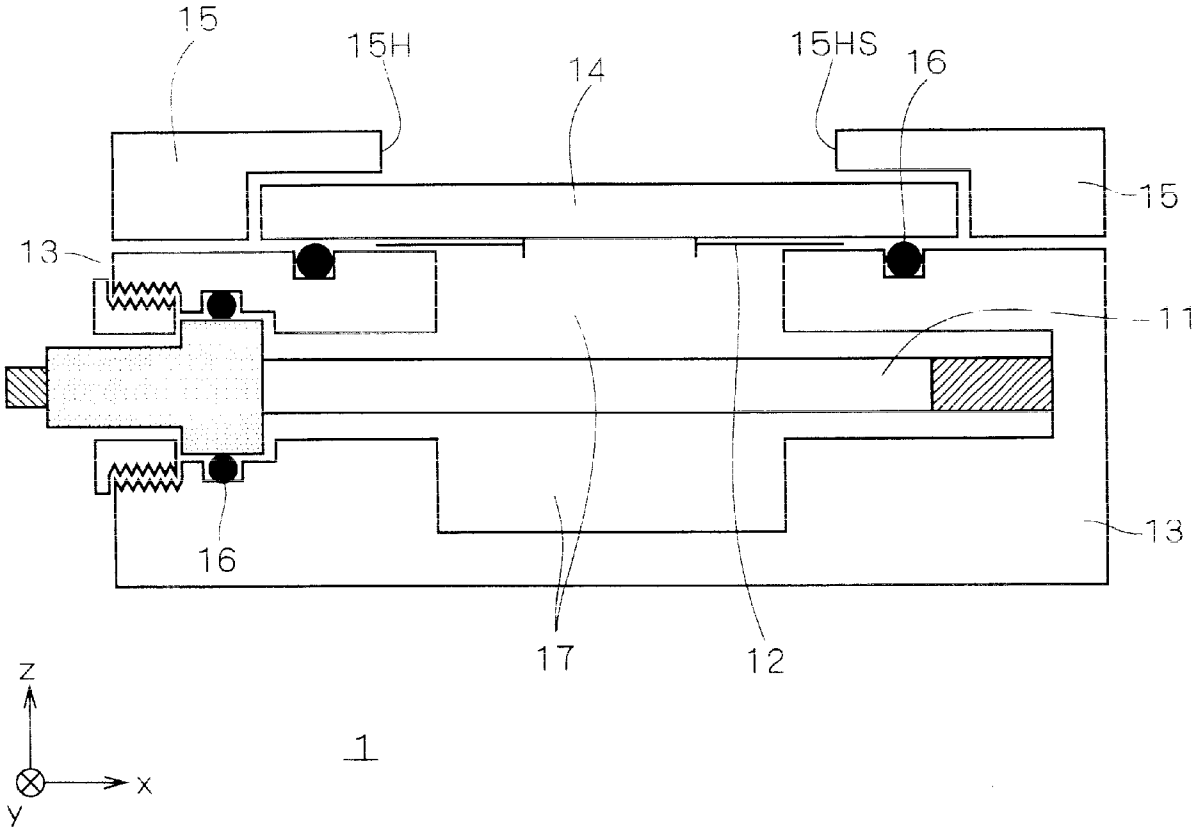
FIG. 14 (PRIOR ART)
FIG. 14 is a vertical sectional view of a conventional light source device.
Figure 15:
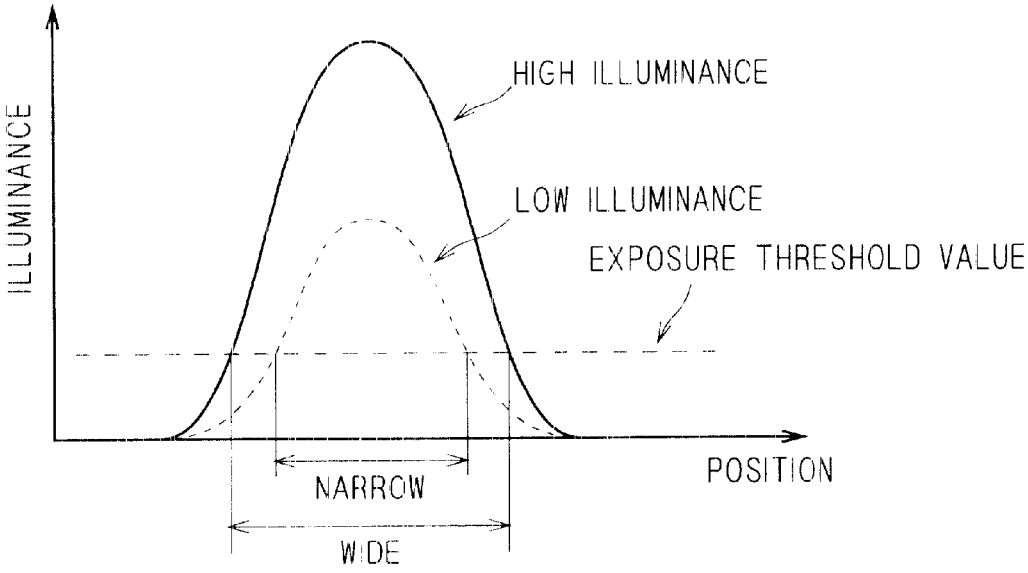
FIG. 15 illustrates the dependence of an exposure pattern width upon illuminance.
Figure 16:
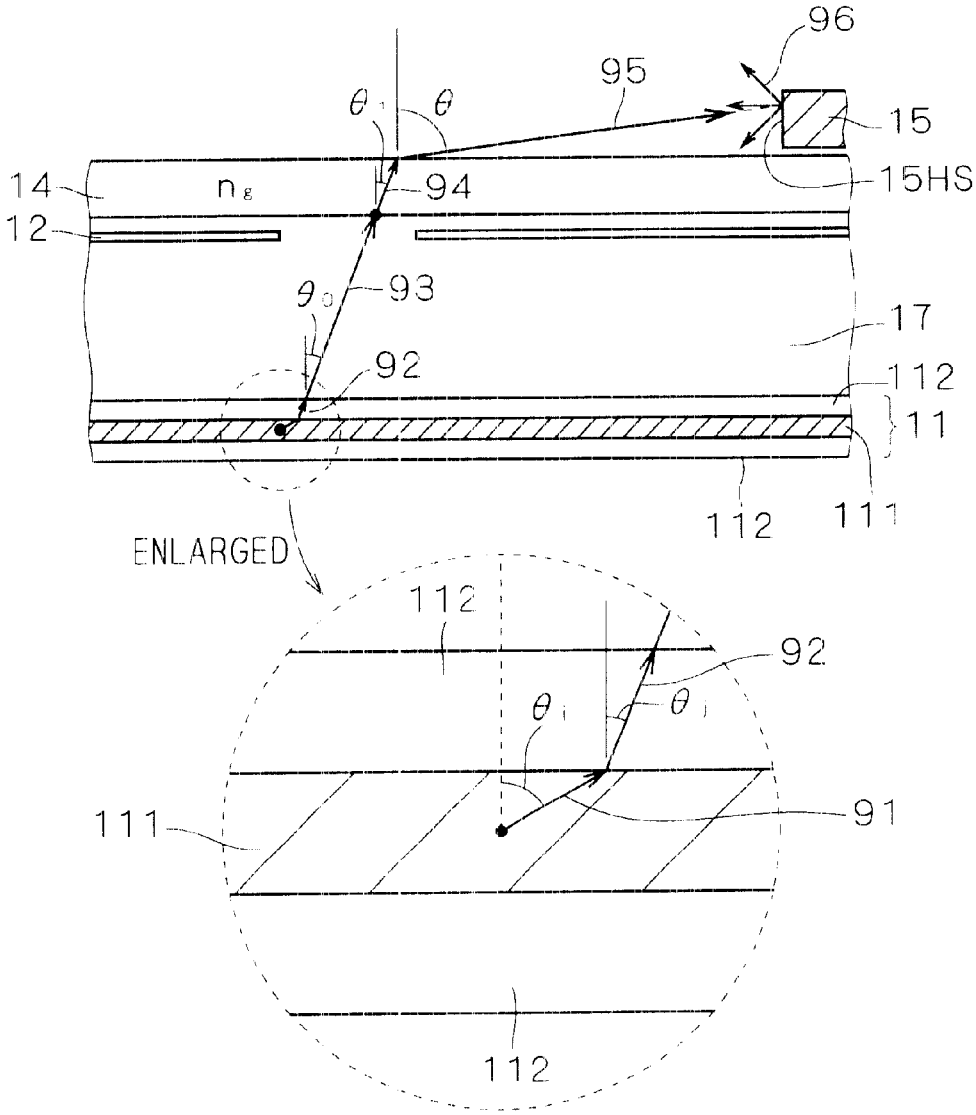
FIG. 16 illustrates a problem with a conventional light source device

FIG. 1 is a vertical sectional view schematically showing an internal structure of a light source device 1 according to the first preferred embodiment. The light source device 1 shown in FIG. 1 comprises a light source housing 13, a mercury light source 11, O-rings 16, a light source slit 12 and an optical window 14 which are identical in construction with those of the conventional light source device shown in FIG. 14. In the light source device 1, the interior space of the light source housing 13 in which the mercury light source 11 is disposed and which has an opening sealed with the lower surface of the optical window 14, with one of the O-rings 16 therebetween, is also filled with a coolant 17. The mercury light source 11 and the light source slit 12 together can be generically defined as a "light source." Features of the light source device 1 are only an optical window retainer 15 and a shielding plate 2 disposed thereover. The structure and arrangement of the optical window retainer 15 and the shielding plate 2 are described hereinafter.

The optical window retainer 15 has a centrally located opening 15H which is, e.g., circular in transverse cross section. The "transverse cross section" used herein means a section of the opening 15H taken along a plane perpendicular to the plane of FIG. 1 and parallel to an upper surface of the optical window 14 (or a plane parallel to an xy plane). The circular shape of the opening 15H in transverse cross section is used herein for convenience in forcing the optical window 14 against the light source housing 13, with the O-ring 16 therebetween. The optical window retainer 15 has an outer end portion 15E bent in an L-shaped configuration and secured to an upper portion of the light source housing 13 by screws not shown in a conventional manner.

The shielding plate 2 has a rectangular opening 2H located centrally thereof and having a width or a dimension as measured in a lateral direction (x-direction) which is smaller than the diameter of the opening 15H (in which case a longitudinal direction is the y-direction perpendicular to the plane of FIG. 1). Part of an L-shaped outer end portion 2E of the shielding plate 2 is secured by screws not shown to the outer surface of the end portion 15E of the retainer 15 so that the center of the plate 2 is positioned a predetermined amount above the upper surface of the optical window retainer 15 (as viewed in the z-direction).

Figure 2:
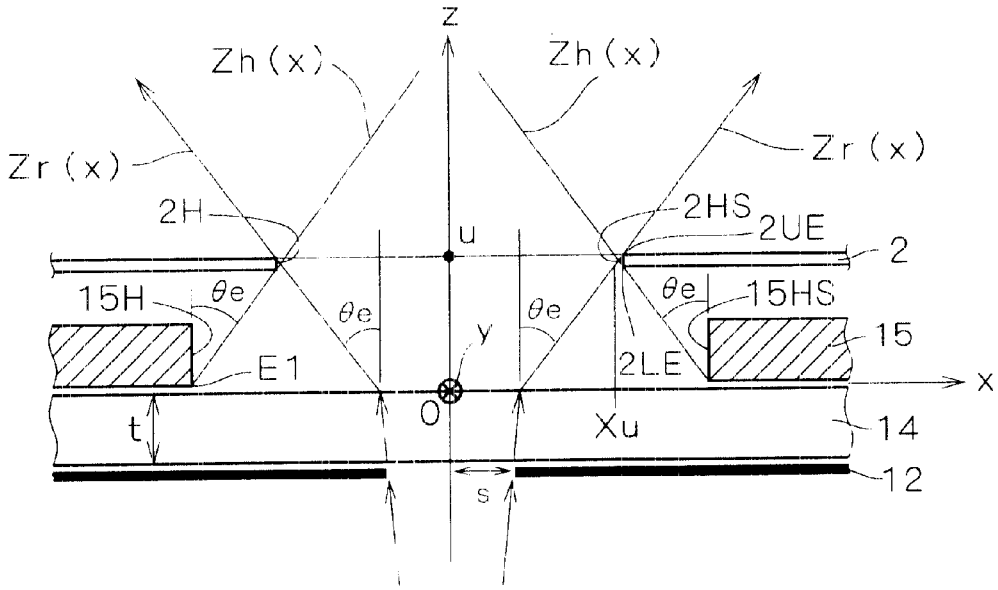
FIG. 2 is a vertical sectional view of a basic structure of a shielding plate and an optical window retainer in the light source device according to the first preferred embodiment of the present invention.

FIG. 2 is an enlarged vertical sectional view of FIG. 1 which shows the arrangement of the optical window retainer 15 and the shielding plate 2 relative to each other. The positional relationship between the shielding plate 2 and the optical window retainer 15 shown in FIG. 2 is determined from the following viewpoint.

Figure 3:
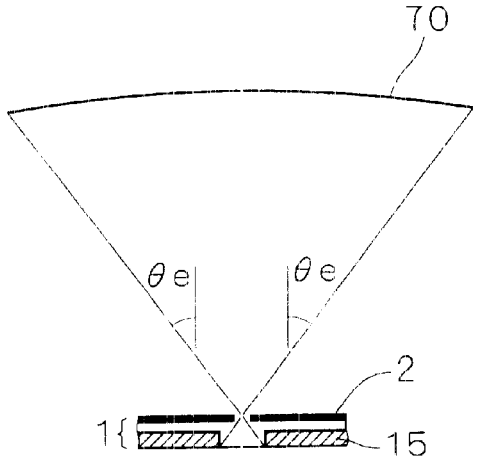
FIG. 3 shows the definition of a usable angle for use in the description of the present invention.
Figure 4:
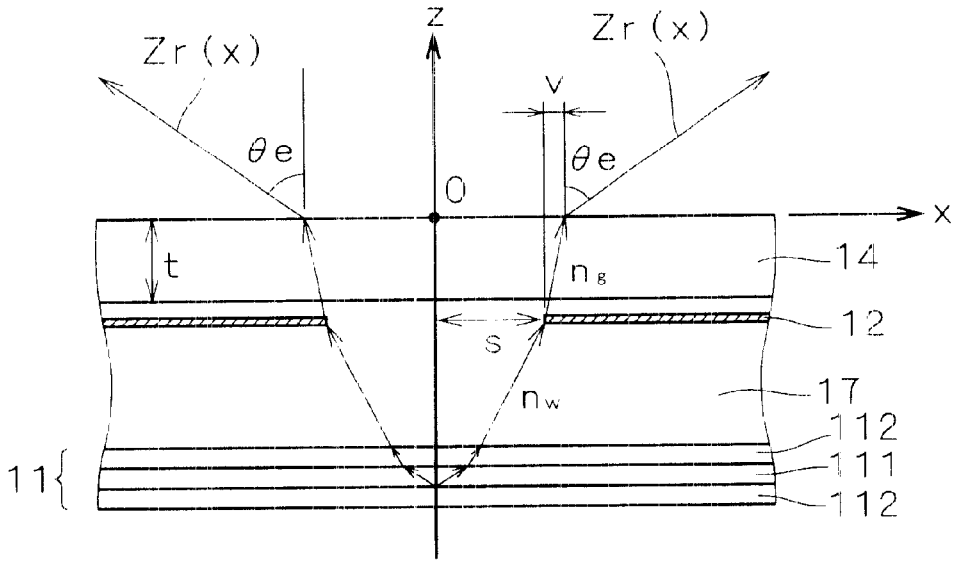
FIG. 4 is a vertical sectional view for illustrating a function for use in designing the shielding plate and the optical window retainer in the light source device according to the present invention.

The shielding plate 2 disposed over the optical window retainer 15 must intercept light reflected or scattered from an opening wall surface 15HS of the optical window retainer 15 and allow light (direct light) required for exposure to pass therethrough. As shown in FIG. 3, the maximum angle of the direct light for use in exposure which is emitted from the mercury light source 11 and emerges from the optical window 14 is referred to as a usable angle (predetermined angle) θe of light (and accordingly a region defined by the outgoing angle which falls within the usable angle θe is a region which the light reflected or scattered from the opening wall surface 15HS of the optical window retainer 15 is not desired to enter and which the light for exposure from the light source must reach). Then, the shielding plate 2 should be placed so as to intercept the direct light emerging from the optical window 14 at an outgoing angle exceeding the usable angle θe. An optical path Zr(x) of light emerging from the optical window 14 into the atmosphere at the usable angle θe is calculated to define a region in which the shielding plate 2 is to be placed, i.e., a region outside the usable angle θe of the direct light. With reference to FIG. 4, the optical path Zr(x) is calculated as $$Zr(x)=(x-s-v)\cot\theta e(x\geqq s+v)$$

$$Zr(x)=-(x+s+v)\cot\theta e(x\leqq -s-v)$$

$$v=\frac{t\cdot\sin\theta e}{\sqrt{n_g^2-\sin^2\theta e}} \tag{5}$$

where t is the thickness of the optical window 14, $n_g$ is the refractive index of the material of the optical window 14, and s is a half width of the opening of the light source slit 12. As described above, in the light source device 1, an opening wall surface 2HS of the shielding plate 2 extends toward a central axis of the optical window 14 (or inwardly) beyond the opening wall surface 15HS of the optical window retainer 15 to a position overlying the optical window 14, and an upper surface edge portion 2UE of the opening wall surface 2HS is positioned on the optical path Zr(x) of the outgoing light or direct light emerging from the optical window 14 into the atmosphere at the usable angle θe.

Therefore, the shielding plate 2 is placed in a position which satisfies $$Xu=u/\cot(\theta e)+v+s \tag{6}$$

where Xu is a half width of the opening 2H as viewed in the x-direction (lateral direction), and u is the height of the upper surface edge portion 2UE as measured from the upper surface of the optical window 14.

The optical window retainer 15 is manufactured and placed in a region outside a boundary line passing through the position of a lower surface edge portion 2LE of the opening wall surface 2HS of the shielding plate 2 and having a line-symmetrical relation to the optical path Zr(x), that is, a boundary line or locus Zh(x) given by Expression (7) (this region including the boundary line Zh(x) and extending away from the z-axis) and also in a region outside the optical path or boundary line Zr(x) given by Expression (5).

$$Zh(x)=-(1/\tan(\theta e))(x-Xu)+u(x\geqq Xu)$$

$$Zh(x)=(1/\tan(\theta e))(x+Xu)+u(x\leqq -Xu) \tag{7}$$

In the instance shown in FIGS. 1 and 2, the opening wall surface 15HS of the optical window retainer 15 is perpendicular to the upper surface of the optical window 14, and a first edge portion E1 of the wall surface 15HS for contact with the upper surface of the optical window 14 is set at a position on the boundary line Zh(x) (i.e., a position satisfying Zh(x)=0).

Figure 5:
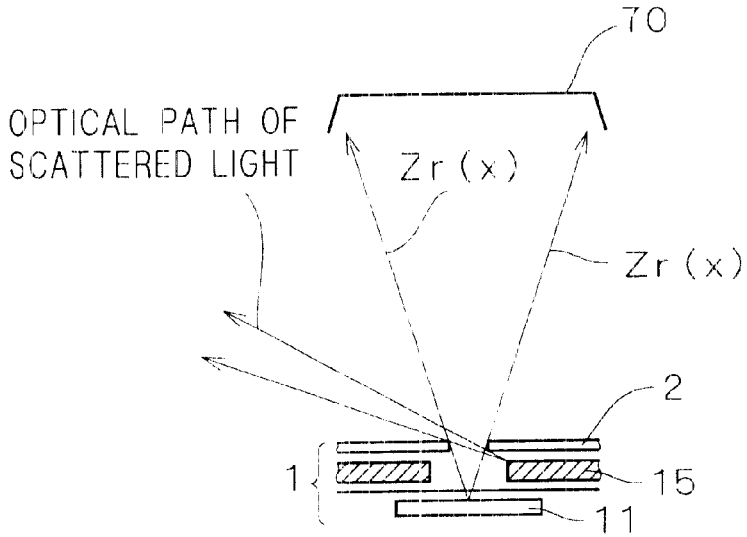
FIG. 5 schematically shows an angle range of scattered light.

Since the shielding plate 2 and the optical window retainer 15 are manufactured and arranged in the above-described manner, the light scattered from the opening wall surface 15HS of the optical window retainer 15 at an angle which is within the usable angle θe is intercepted by the shielding plate 2 overlying the wall surface 15HS. On the other hand, most of the light scattered at an angle exceeding the usable angle θe is similarly intercepted by the shielding plate 2 but part of the light scattered at an angle exceeding the usable angle θe pastes through the region surrounded by the optical path Zr(x) near the light source housing. However, as schematically shown in FIG. 5, the light source device 1 and the inner surface (or the phosphor screen) of the CRT panel 70 are spaced a sufficient distance (e.g., about 300 mm) apart from each other, and the width (e.g., about 10 mm) of the opening 2H of the shielding plate 2 limits the angle range of the scattered light passing through the opening 2H of the shielding plate 2. Therefore, the scattered light passing through the opening 2H merely passes across part of the region surrounded by the optical path Zr(x) before reaching the inner surface of the CRT panel 70, and does not reach the inner surface of the CRT panel 70.

The usable angle θe ranges from greater than 0° to less than 90°, and may be set at any value.

With reference to FIG. 2, the usable angle θe is set at 45°, the thickness t of the optical window 14 is set at 2 mm, and the half width s of the opening of the light source slit 12 is set at 4 mm. If the upper surface edge portion 2UE or the upper surface of the opening 2H of the shielding plate 2 is placed at a position 7 mm above the interface between the optical window 14 and the optical window retainer 15 (a position satisfying z=u=7 mm in FIG. 2), then Xu=12.1 mm is obtained (where the refracting index $n_g$ of synthetic quartz equals 1.47454 herein). Then, the boundary line Zh(x) is $$Zh(x)=-(x-Xu)+u=-x+19.1(12.15\leqq x\leqq 19.1)$$

$$Zh(x)=(x+Xu)+u=x+19.1(-19.1\leqq x\leqq -12.1) \quad (8)$$

where Xu=12.1 (mm) and u=7 (mm).

The manufacture and placement of the shielding plate 2 and the optical window retainer 15 in the above-mentioned manner allow only the direct light emitted from the mercury light source 11 and emerging from the optical window 14 at an angle which is within the usable angle θe to pass through the shielding plate 2 to reach the inner surface of the CRT panel while intercepting the direct light emerging from the optical window 14 at other angles, as illustrated in FIGS. 2 and 5. Additionally, if the direct light emerging at an angle exceeding the usable angle θe impinges upon the opening wall surface 15HS of the optical window retainer 15 to generate reflected or scattered light, the reflected or scattered light does not reach the inner surface of the CRT panel through the region surrounded by the optical path Zr(x).

(Modifications of First Preferred Embodiment)

(1) In the first preferred embodiment (shown in FIG. 2), the shielding plate 2 is placed so that the upper surface edge portion 2UE of the opening wall surface 2HS of the shielding plate 2 is positioned on the optical path Zr(x). Alternatively, the opening dimension (as measured in the x-direction) of the shielding plate 2 may be changed so that the upper surface edge portion 2UE of the opening wall surface 2HS of the shielding plate 2 is positioned outside and near the optical path Zr(x). An example of this placement is illustrated in FIG. 6.

Figure 6:
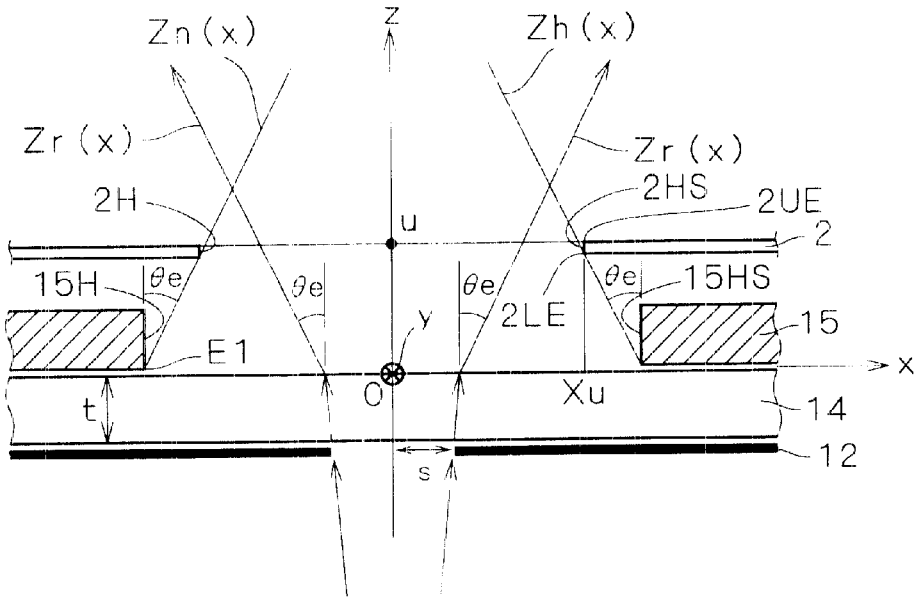
FIG. 6 is a vertical sectional view of a basic structure of the shielding plate and the optical window retainer in the light source device according to a modification of the first preferred embodiment of the present invention.

With reference to FIG. 6, the half width Xu of the opening 2H of the shielding plate 2 is greater than that of the first preferred embodiment shown in FIG. 2. The optical window retainer 15 of FIG. 6 is similar in shape and arrangement to that of FIG. 2. For example, when the half width Xu of the opening 2H of the shielding plate 2 is set at 13 mm, the function expression Zh(x) is $$Zh(x)=-x+20(13\leqq x\leqq 20\ (\text{mm}))$$

$$Zh(x)=x+20(-20\leqq x\leqq -13\ (\text{mm})) \quad (9)$$

Therefore, the optical window retainer 15 of FIG. 6 should be manufactured and placed so as to lie in the region outside (and including) the boundary line given by Expression (9).

The reason for and advantage of the setting of the half width Xu as illustrated in FIG. 6 are as follows. The shielding plate 2 manufactured to completely intercept the (direct) light emerging at other than the usable angle as in the first preferred embodiment (shown in FIG. 2) will also intercept the light required for exposure if the shielding plate 2 deviates from its proper position. In consideration for the occurrence of such deviation, it is desired to produce the actual shielding plate 2 having the opening 2H of a slightly greater width. This modification (1) shows an application having the shielding plate 2 produced based on such considerations. In this case, the light scattered from the opening wall surface 15HS is also prevented from entering the region surrounded by the optical path Zr(x) and reaching the inner surface of the CRT plate.

(2) The opening wall surface 15HS of the optical window retainer 15 may be of any configuration so far as the retainer 15 lies in the region outside the optical path Zr(x) and also in the region outside the boundary line expressed by the function expression Zh(x), thereby producing similar functions and effects.

Figure 7:
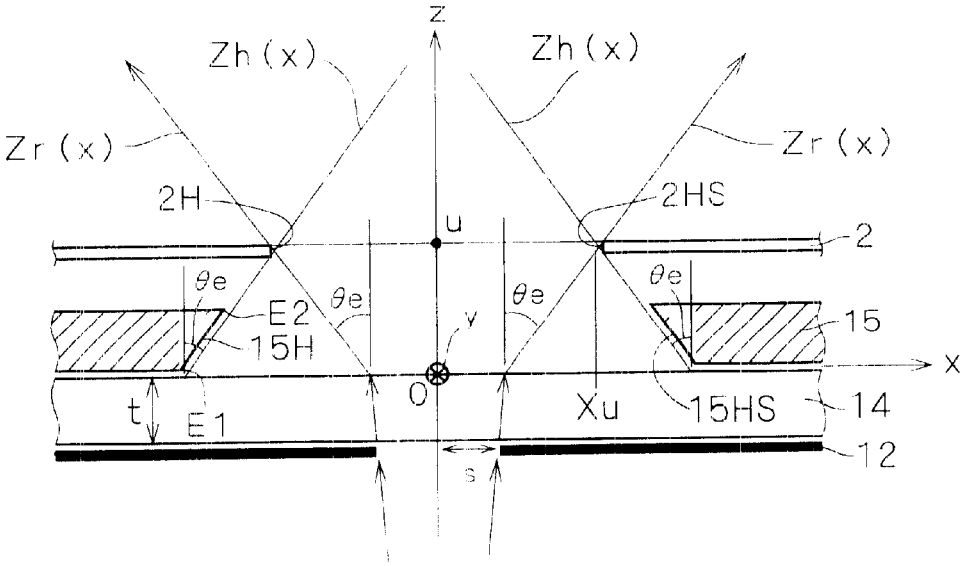
FIG. 7 is a vertical sectional view of a basic structure of the shielding plate and the optical window retainer in the light source device according to another modification of the first preferred embodiment of the present invention.

FIG. 7 shows the optical window retainer 15 according to the modification (2) of the first preferred embodiment used in place of the optical window retainer 15 of the first preferred embodiment shown in FIG. 2. The opening wall surface 15HS of the retainer 15 is tapered along the boundary line Zh(x). Additionally, the light source device of FIG. 6 may comprise the optical window retainer 15 of tapered configuration shown in FIG. 7 in place of the optical window retainer 15 of FIG. 6.

(Second Preferred Embodiment)

Although the shielding plate and the optical window retainer are separately produced in the first preferred embodiment and the modifications (1) and (2) thereof, the shielding plate and the optical window retainer may be integrated together into one-piece configuration, thereby producing similar functions and effects. A second preferred embodiment of the present invention utilizes this consideration.

Figure 8:
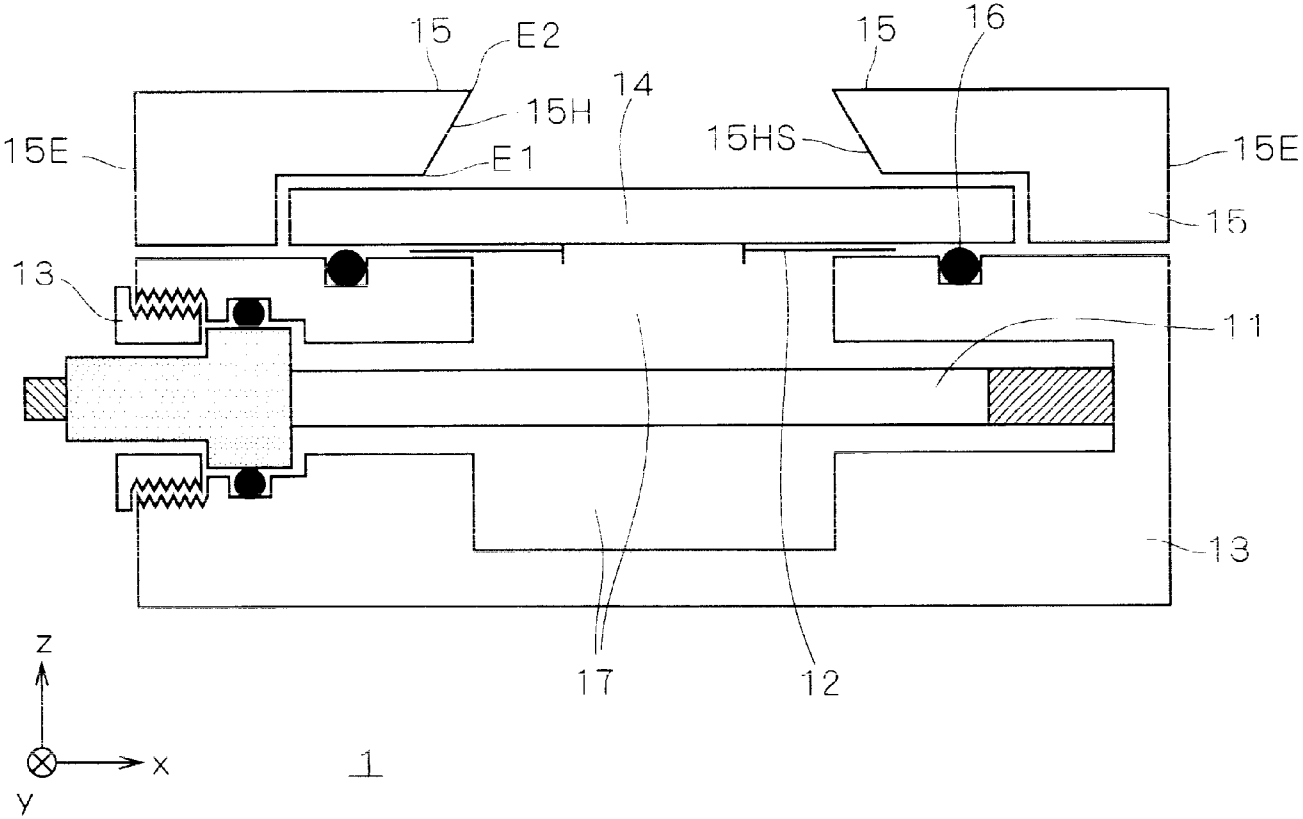
FIG. 8 is a vertical sectional view of a structure of the light source device according to a second preferred embodiment of the present invention.
Figure 9:
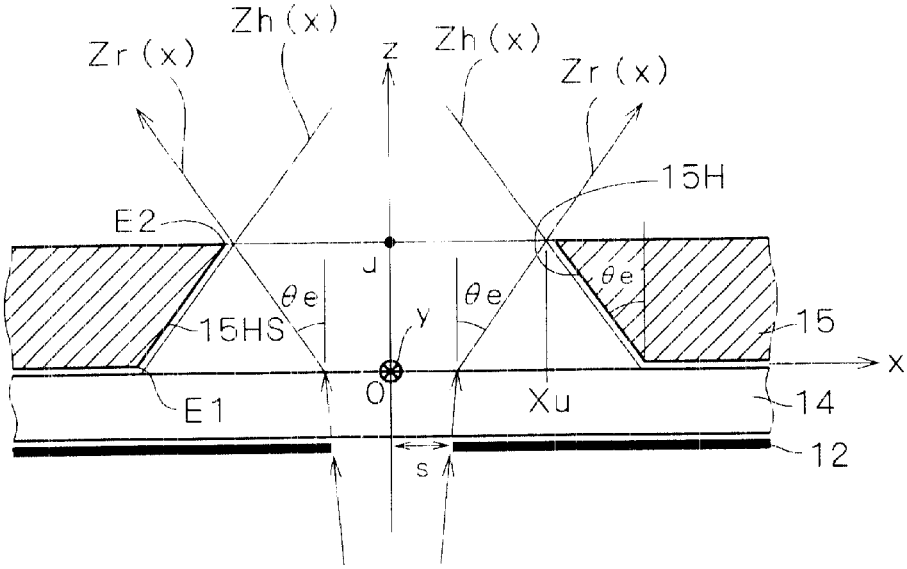
FIG. 9 is a vertical sectional view showing placement of the optical window retainer in the light source device according to the second preferred embodiment of the present invention.

FIG. 8 is a vertical sectional view schematically showing an internal structure of the light source device 1 according to the second preferred embodiment. FIG. 9 is an enlarged vertical sectional view of the optical window 14 and the opening 15H of the optical window retainer 15 shown in FIG. 8, and illustrates the placement of the retainer 15. It will be apparent from FIGS. 8 and 9 that the optical window retainer 15 according to the second preferred embodiment corresponds to a one-piece optical window retainer into which the shielding plate 2 and the optical window retainer 15 shown in FIGS. 1 and 2 are integrated together. More specifically, the opening wall surface 15HS of the optical window retainer 15 is tapered along the boundary life given by the function expression Zh(x) described with respect to the first preferred embodiment, and a second edge portion E2 opposite from the first edge portion E1 at which the wall surface 15HS and the upper surface of the optical window 14 contact each other is positioned on the optical path Zr(x) described with respect to the first preferred embodiment. Therefore, only the direct light emerging from the upper surface of the optical window 14 into the atmosphere at an angle which is within the usable angle ec can contribute to exposure. Additionally, the direct light having an outgoing angle greater than the usable angle θe and reflected or scattered from the opening wall surface 15HS is prevented from reaching the inner surface of the CRT. panel through the region surrounded by the optical path Zr(x), and accordingly prevented from being superimposed upon the exposure light. Moreover, the second preferred embodiment eliminates the need to manufacture and align the shielding plate as has been done in the first preferred embodiment, to provide an advantage in reduction in the number of parts.

(Modifications of Second Preferred Embodiment)

Figure 10:
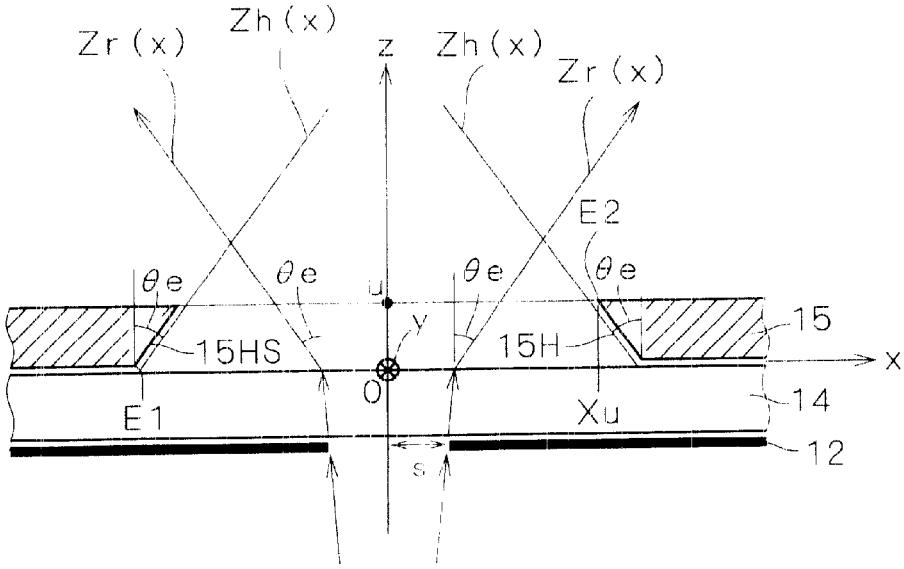
FIG. 10 is a vertical sectional view showing placement of the optical window retainer in the light source device according to a modification of the second preferred embodiment of the present invention.
Figure 11:
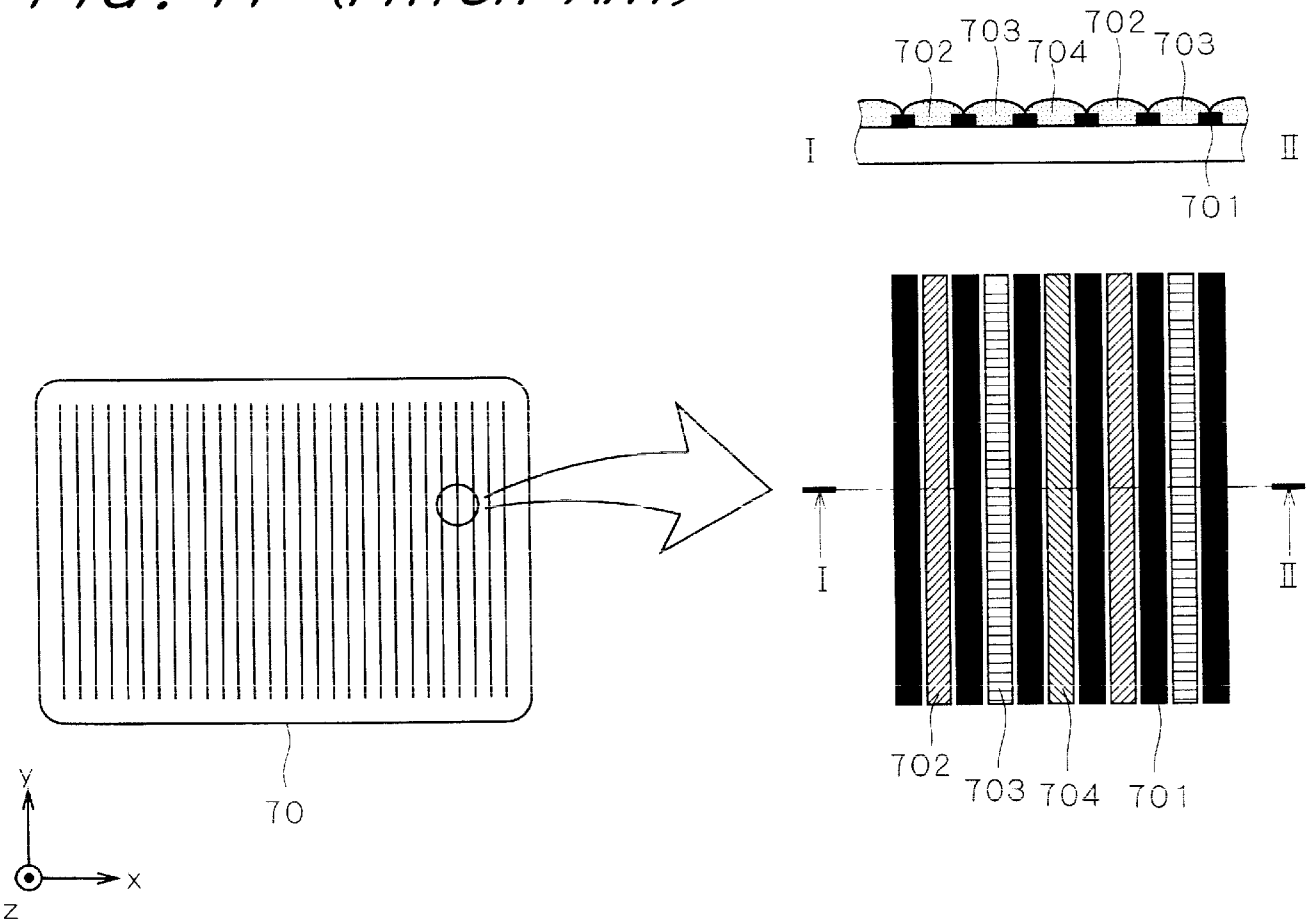
FIG. 11 (PRIOR ART)
FIG. 11 schematically illustrates a structure of a CRT panel.

(1) The shielding plate 2 and the optical window retainer 15 may be integrated into one-piece configuration also when the opening wall surface 2HS of the shielding plate 2 is spaced slightly outwardly from the boundary line indicated by the optical path Zr(x) in a manner described with respect to the modification (1) of the first preferred embodiment. FIG. 10 shows such a one-piece configuration in this case. The light source device of FIG. 10 according to the modification (1) of the second preferred embodiment also produces functions and effects similar to those of the light source device 1 shown in FIG. 6.

(2) Although the opening wall surface 15HS of the optical window retainer 15 is of tapered configuration in the second preferred embodiment and the modification (1) thereof, the opening wall surface 15HS of the optical window retainer 15 may be of any configuration, provided that the opening wall surface 15HS does not come within a region inside the boundary line given by the function expression Zh(x). The requirements to be met are that the second edge portion E2 of the opening wall surface 15HS is positioned either on the optical path Zr(x) or outside and near the optical path Zr(x), and that the optical window retainer 15 is placed in a region including and outside the boundary line given by the function expression Zh(x) which is in line-symmetrical relation to the optical path Zr(x).

(Additional Modifications)

Although the mercury lamp 11 extending linearly in the x-direction is used as the Light source in the first and second preferred embodiments and the modifications thereof, a mercury lamp extending linearly in the y-direction perpendicular to the x-direction or a lamp of any cross-sectional configuration may be used as the light source instead. Depending on the phosphor types, a lamp emitting light having other wavelengths may be used in place of the mercury lamp. The present invention may be applied to a light source device employing such various lamps to provide the light source device producing effects similar to those of the first and second preferred embodiments.

While the invention has been described in detail, the foregoing description is in all aspects illustrative and not restrictive. It is understood that numerous other modifications and variations can be devised without departing from the scope of the invention.

What is claimed is:

1. A light source device incorporated in an exposure apparatus for use in manufacturing cathode ray tube panel, said light source device comprising:

a light source;

a light source housing configured to hold said light source therein;

an optical window configured to cause light from said light source to emerge into the atmosphere;

an optical window retainer configured to fix said optical window to said light source housing; and a shielding plate placed over said optical window and said optical window retainer and having an opening wall surface extending inwardly beyond an opening wall surface of said optical window retainer to a position overlying said optical window, wherein an upper surface edge portion of said opening wall surface of said shielding plate is positioned in a region including and outside an optical path of outgoing light emerging from said optical window into said atmosphere at a predetermined angle, and wherein said optical window retainer is positioned in a region including and outside a boundary line passing through a position of a lower surface edge portion of said opening wall surface of said shielding plate and having a line-symmetrical relation to said optical path of said outgoing light.

2. The light source device according to claim 1, wherein said upper surface edge portion of said opening wall surface of said shielding plate is positioned on said optical path of said outgoing light.

3. The light source device according to claim 1, wherein said upper surface edge portion of said opening wall surface of said shielding plate is positioned outside and near said optical path of said outgoing light.

4. The light source device according to claim 1, wherein an edge portion of said opening wall surface of said optical window retainer in contact with an upper surface of said optical window is set at a position on said boundary line.

5. The light source device according to claim 4, wherein said opening wall surface of said optical window retainer is a surface perpendicular to said upper s of said optical window.

6. The light source device according to claim 4, wherein said opening wall surface of said optical window retainer is a tapered surface extending along said boundary line.

7. The light source device according to claim 1, wherein said predetermined angle is a usable angle of light defined as a maximum angle of direct light emerging from said optical window into said atmosphere and to be used for exposure.

8. An exposure apparatus comprising said light source device as recited in claim 1.

9. A light source device incorporated in an exposure apparatus for use in manufacturing a cathode ray tube panel, said light source device comprising:

a light source;

a light source housing configured to hold said light source therein;

an optical window configured to cause light from said light source to emerge into the atmosphere; and an optical window retainer configured to fix said optical window to said light source housing and having an opening, wherein an opening wall surface of said optical window retainer has a first edge portion in contact with a surface of said optical window and a second edge portion on the opposite side from said first edge portion, and said second edge portion is positioned in a region including and outside an optical path of outgoing light emerging from said optical window into said atmosphere at a predetermined angle, and wherein said optical window retainer is positioned in a region including and outside a boundary line passing through said second edge portion and having a line-symmetrical relation to said optical path of said outgoing light.

10. The light source device according to claim 9, wherein said second edge portion is positioned on said optical path of said outgoing light.

11. The light source device according to claim 9, wherein said second edge portion is positioned outside and near said optical path of said outgoing light.

12. The light source device according to claim 9, wherein said opening wall surface of said optical window retainer is a tapered surface extending along said boundary line.

13. The light source device according to claim 9, wherein said predetermined angle is a usable angle of light defined as a maximum angle of direct light emerging from said optical window into said atmosphere and to be used for exposure.

14. An exposure apparatus comprising said light source device as recited in claim 9.

* * * * *